United States Patent [19]

Berzin

[11] Patent Number: 4,941,534

[45] Date of Patent: Jul. 17, 1990

[54] METHOD AND APPARATUS FOR SEALING A CASING IN A SUBTERRANEAN WELL BORE

[75] Inventor: Vel Berzin, Houston, Tex.

[73] Assignee: Baker Hughes Incorporated, Houston, Tex.

[21] Appl. No.: 345,441

[22] Filed: Apr. 28, 1989

[51] Int. Cl.[5] ..... E21B 33/13; E21B 34/10

[52] U.S. Cl. ..... 166/285; 166/187; 166/323; 166/374

[58] Field of Search ..... 166/285, 373, 386, 387, 166/185, 187, 188, 192, 195, 319, 321, 323, 332, 242, 374; 251/369; 277/34, 34.3, 34.6

[56] References Cited

U.S. PATENT DOCUMENTS 3,853,177 12/1974 Mott ..... 166/187

4,602,684 7/1986 Van Wormer et al. ..... 166/321

FOREIGN PATENT DOCUMENTS 0489858 2/1976 U.S.S.R. ..... 166/187

*Primary Examiner*—Stephen J. Novosad

*Assistant Examiner*—Terry Lee Melius

*Attorney, Agent, or Firm*—Hubbard, Thurman, Turner & Tucker

[57] ABSTRACT

An inflatable packer is mounted on the bottom end of a well casing by valve housing defining an annular chamber which is in communication at its lower end with the inflatable packer. A radial port is provided in the inner wall of the annular chamber for communicating with the bore of the casing and, during run-in, such radial port is closed by a sleeve valve shearably secured in the annular chamber. Application of pressured inflation fluid to the sleeve valve causes it to shift to a position permitting inflation fluid to flow through the annular chamber to the inflatable packer. Intermediate the first sleeve valve and the inflatable packer is a second sleeve valve which is shearably secured in a normally open position with respect to fluid flow through the annular chamber. When the pressure of the inflation fluid increases when the inflatable packer is filled with inflation fluid, such increased fluid pressure exerts an axial force on the second sleeve valve causing it to shift to interrupt communication between the annular chamber and the inflatable packer. A subsequent reduction in fluid pressure permits a third spring biased sleeve valve to move in the annular chamber to a closing position relative to the radial port.

7 Claims, 6 Drawing Sheets

METHOD AND APPARATUS FOR SEALING A CASING IN A SUBTERRANEAN WELL BORE

BACKGROUND OF THE INVENTION

1. Field of the Invention

The invention relates to a method and apparatus for sealing of a casing in a subterranean well, and particularly to a method employing an inflatable packer on the bottom of the casing which is filled with inflation fluid to expand into sealing engagement with the well bore.

2. Summary of the Prior Art

The cementing of casings in subterranean wells is a time honored procedure. In many cases, the drilled well bore extends downwardly a substantial distance beyond the region of the well for which a casing is required. Due to the high cost of casing, it would be highly desirable to utilize a casing string having a length just sufficient to reach the desired area of the well and not extending to the bottom of the well bore. Inflatable packers have been utilized in the past to accomplish this objective and have been filled with inflation fluid, such as cementing fluid in order to provide an inflation fluid barrier between the bottom end of the casing string and the well bore. After installation of the inflatable packer, cement is applied by conventional apparatus to surround the upper portions of the casing string.

The fluid supply conduits heretofore employed for introducing inflation fluid into the inflatable packer have been characterized by significantly small flow areas, thus increasing the time for the cementing operation and providing an environment where a portion of the flow path might be readily plugged by the cementing fluid before the inflatable packer is completely filled.

Since cementing or other inflation fluid has to be supplied to the inflatable packer through the casing bore, special valving apparatus is required to first, prevent well fluid from entering the inflatable packer during run-in; secondly, to open a passage for flow of cementing fluid into the inflatable packer; thirdly, to seal off the aforementioned fluid passage in response to the expansion and filling of the inflatable packer; and lastly, to permanently close any ports in the casing wall required for the passage of cementing or other inflation fluid into the inflatable packer. A method and apparatus for automatically conditioning the fluid supply conduits for the inflatable packer to accomplish the aforedescribed operations in sequence has not been available in the prior art.

SUMMARY OF THE INVENTION

The invention provides a valving structure comprising concentrically arranged inner and outer walls interposed between the bottom end of a casing string and the top end of a conventional inflatable packer. The inner and outer walls define an annular chamber which, at its bottom end, is in communication with the inlet passage for pressured fluid to be applied to the inflatable packer. One or more radial ports are provided in the inner wall of the valving structure to provide communication between the bore of the casing string and the annular chamber. In the run-in position of the apparatus, a pair of abutting sleeve valves seal off these inlet ports. The uppermost valve is urged downwardly by a spring while the lower sleeve valve is held in position by a shear pin. Upon supplying pressured inflation fluid to the bore of the casing string, the lower sleeve valve will be shearably released to move downwardly and permit pressured cementing fluid to pass around such valve. The upper sleeve valve is held in substantially the same position by the fluid pressure acting on the bottom end thereof.

Intermediate the lower sleeve valve and the inlet passage to the inflatable packer, a third sleeve valve is mounted in the annular chamber. The third sleeve valve is configured to permit the ready passage of inflation fluid around the valve in its run-in position, in which it is secured by one or more shear screws. As the fluid pressure of the inflation fluid increases when the inflatable packer is expanded and filled, such pressure acts on a differential seal area provided on the third sleeve element and produces an axial force on such sleeve element permitting it to move axially to effect a closing of the annular chamber so that no further fluid can flow towards the inflatable packer.

The subsequent reduction in pressure of the inflation fluid permits the upper sleeve valve to shift downwardly under its spring bias and effect the permanent closing of the radial ports.

Further advantages of the invention will be readily apparent to those skilled in the art from the following detailed description, taken in conjunction with the annexed sheets of drawings on which is shown a preferred embodiment of the invention,

DESCRIPTION OF PREFERRED EMBODIMENT

Figure 1A:
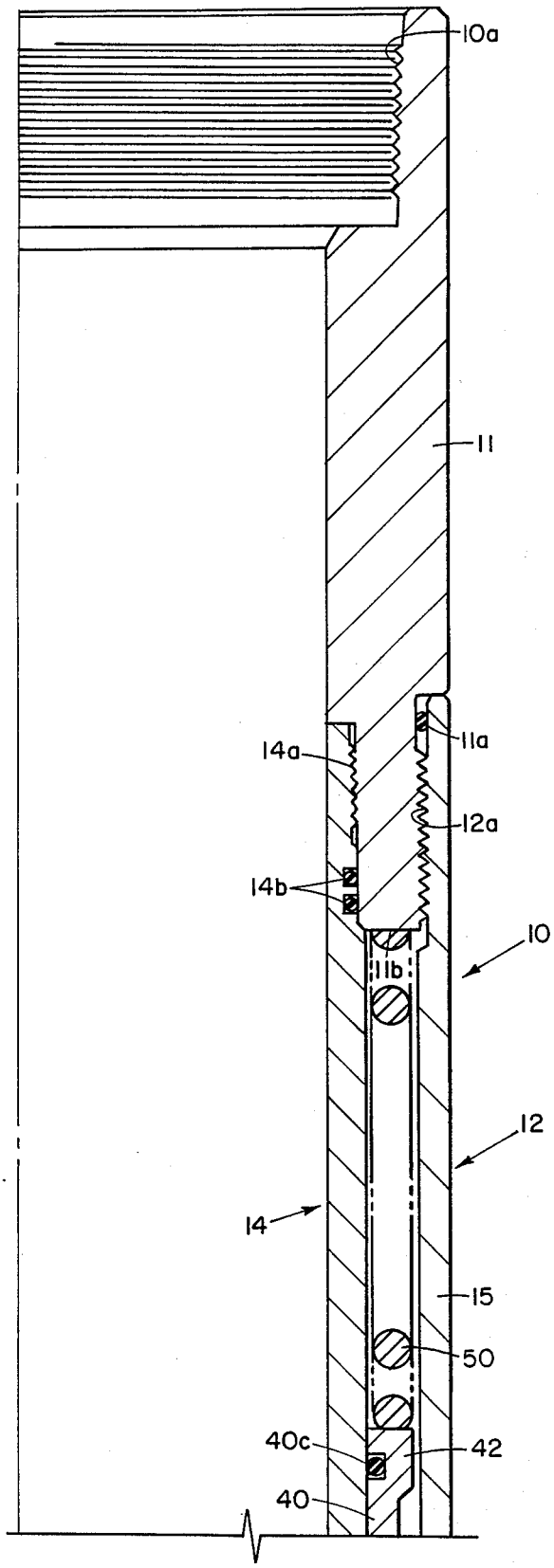
FIGS. 1A, 1B and 1C collectively represent a vertical, sectional view of an inflatable packer supplied with pressured inflation fluid through a valving apparatus embodying this invention, with the components thereof shown in their run-in position.
Figure 1B:
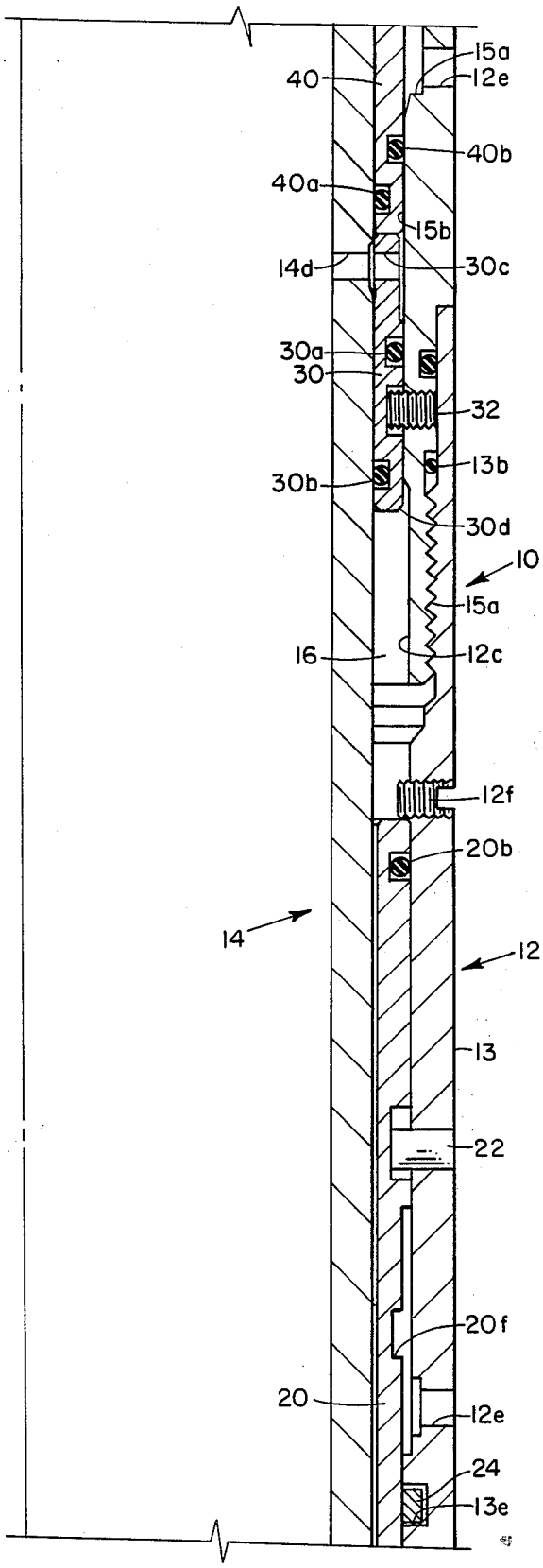

Referring to the drawings, an apparatus embodying this invention includes a valving assemblage 10 having internal threads **10*a* for connection to the bottom end of a casing string (not shown). The bottom end of the valving assemblage 1 is in turn connected by external threads 10*b* to internal threads 5*a* provided on the upper end of a conventional inflatable packer unit 5. Since the inflatable packer unit 5 is completely conventional, it has only been shown schematically. The threads 10*b* and 5*a* are sealed by an O-ring 10*c***.

The valving unit 10 comprises a doublewalled structure having an external or outer wall 12 secured at its upper end by internal threads **12*a* to a connecting sub 11. Such threads are sealed by an O-ring 11*a*. The inner wall 14 is provided at its upper end with external threads 14*a* which are connected to internal threads on the bottom end of connecting sub 11 and sealed by O-rings 14*b***.

Inner wall 14 extends throughout the entire length of the valving assemblage 10. Outer wall 12 comprise an upper part 15 having external threads 15*a* secured to internal threads on a lower part 13*a*, which threads are sealed by an O-ring 13*b*. The lower end of lower part 13 is connected to the internal threads 5*a* on the inflatable packer 5, as has been previously mentioned.

Between the inner walls 14 and the outer walls 12, an annular fluid passage 16 is defined. Within this chamber, three separate sleeve valve elements 20, 30 and 40 are respectively mounted in vertically spaced relationship. The lowermost sleeve valve 20 supports an O-ring 20*a* which is in sealing engagement with the exterior surface of the inner wall 14. In the run-in position of sleeve valve 20, one or more shear screws 22 which pass through the outer wall 12 hold the lower sleeve valve 20 in a fixed axial position. In this position, an O-ring 20*b* on the lower sleeve valve 20 sealingly engages the internal surface of the outer wall 12. However, one or more radial ports 20*c* are provided intermediate O-rings 20*a* and 20*b*. Thus, fluid can pass downwardly around the lower sleeve valve 20 while it remains in its shearably secured run-in position.

The extreme lower end 20*d* of the lower sleeve valve 20 is of reduced thickness and a sealing element 20*e* mounted on the exterior of lower end portion 20*d* is not in engagement with any part of the outer wall 12 in the run-in position of the lower sleeve valve 20. If, however, the shear pin 22 is sheared, the lower sleeve valve 20 can move downwardly to enter a portion of the fluid passage 16*a* which is of reduced diameter due to the provision of an internally thickened portion 13*d* on the bottom end of the lower wall part 13. The outer seal 20*e* can then enseal off the passage 16.

Figure 3B:
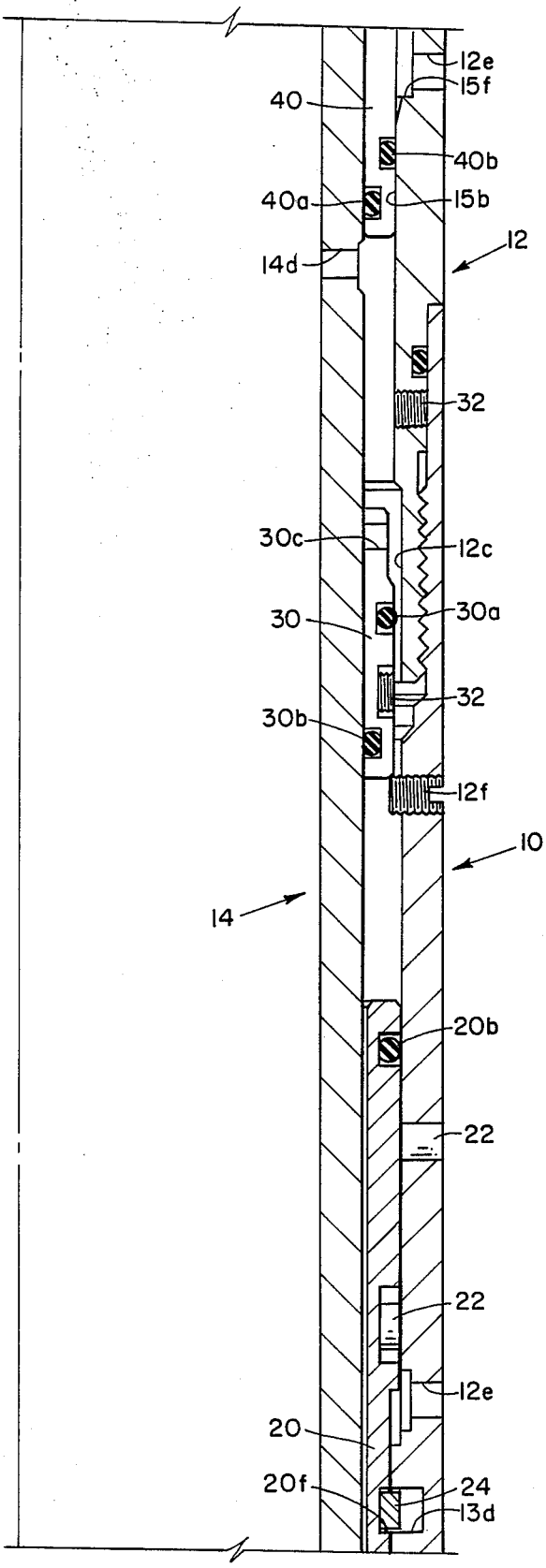

When the lower sleeve valve 20 moves downwardly, in a manner that will be hereinafter described, a C-ring 24 mounted in an appropriate groove 13*e* of the lower outer wall part 13 snaps into a groove 20*f* provided on the exterior of the lower sleeve valve 20 and permanently locks the sleeve valve 20 in the lowered position. Thus, the lower sleeve valve 20 has two positions, namely, a run-in position in which it is secured by shear pin 22 wherein fluid can readily pass through a large flow area around and through the sleeve valve 20 and enter the inlet passage 16*a* to the inflatable packer 5. In the second position, the lower sleeve valve 20 is moved downwardly to seal off the fluid passage 16 and is permanently locked in such position through the cooperation of the C-ring 24 with the groove 20*f* on the exterior of the sleeve valve 20 (FIG. 3B).

The intermediate sleeve valve 30 is provided with an external O-ring 30*a* and an internal O-ring 30*b* which respectively cooperate with an inwardly enlarged surface 15*b* of upper outer wall part 15 and the external surface of inner wall 14. The intermediate sleeve valve 30 is secured in its run-in position by one or more shear screws 32 which traverse the upper outer wall part 15. The intermediate sleeve valve 30 is further provided with one or more radial ports 30*c* which respectively communicate with one or more radial ports 14*d* provided in the inner wall 14. Thus, any fluid pressure existing within the bore of the casing string is free to enter that portion of the annular chamber 16 which is intermediate the sleeve valve 30 and the upper sleeve valve 40, but cannot pass downwardly due to the presence of O-rings 30*a* and 30*b* and, as will be described, cannot pass upwardly due to O-rings 40*a* and 40*b* provided on the upper sleeve element 40.

When the pressure in the bore of the casing string is increased to a predetermined level, the downward force exerted on the intermediate sleeve valve 30 will effect the shearing of the shear screw 32 and result in a downward movement of the intermediate sleeve valve 30 until the bottom edge surface 30*d* contacts one or more plugs 13*e* which traverse the upper portion of the upper outer wall part 13. In this position, pressured fluid can flow freely around the intermediate sleeve valve 30 and hence pass downwardly around the lower sleeve valve element 20 and into the inflatable packer. Such pressured fluid is preferably a cementing fluid which, after expanding the inflatable packer unit into sealing engagement with the wall bore, will harden and maintain a sealing engagement with the wall of the well bore, so long as the elastomeric portion of the inflatable packer 5 remains intact.

The third or upper sleeve valve element 40 has internal and external O-rings 40*a* and 40*b* cooperating with the walls of chamber 16 and thus preventing upward flow of fluid from the inner wall ports 14*d*. The upper sleeve valve unit 40 is biased downwardly by a spring 50 which is mounted between a radially enlarged top portion 42 of the upper sleeve valve 40 and the downwardly facing end surface 11*b* of the connecting sub 11. So long as the intermediate sleeve valve 30 remains in its run-in position, the upper sleeve valve 40 will also remain in such position. However, when the fluid pressure within the casing bore is increased to a level to shear the shear pin 34 and shift the intermediate valve sleeve downwardly, the upper sleeve valve 40 will not move downwardly any substantial distance due to the fact that the same fluid pressure is acting on this valve in an upward direction. Hence, sleeve valve 40 will not interfere with the flow of pressured cementing fluid through the radial ports 14*d*.

Figure 4A:
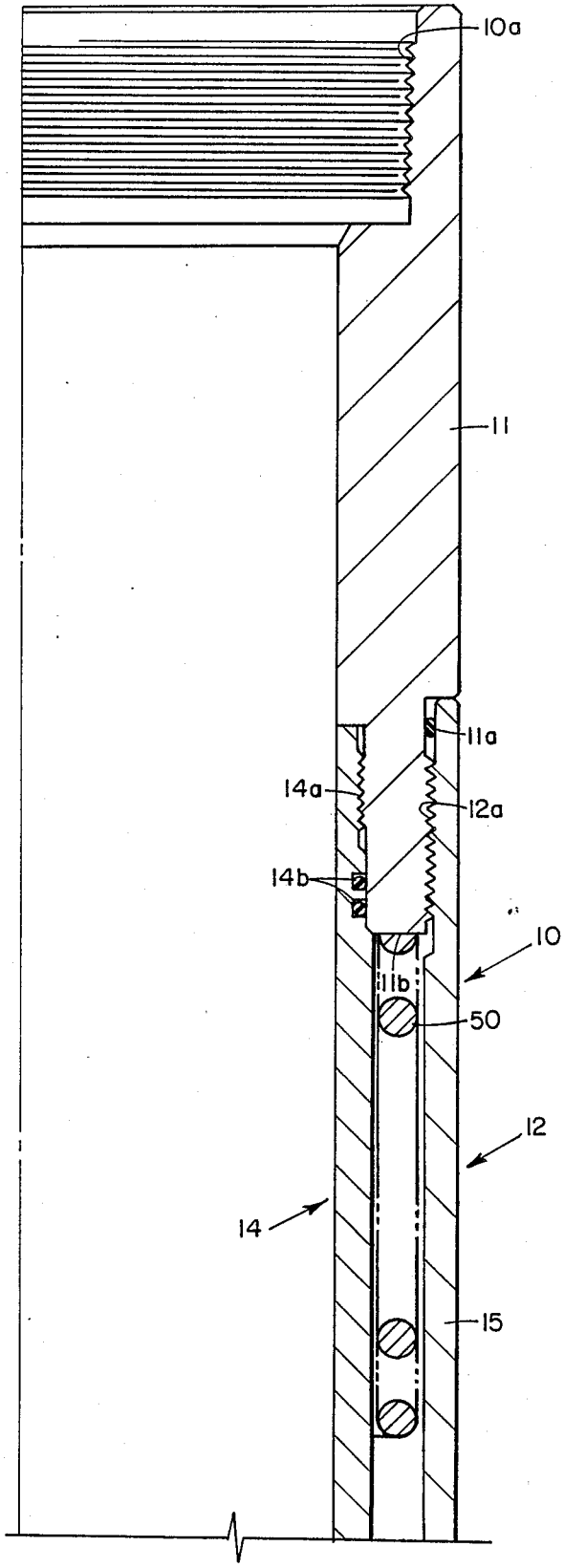
FIGS. 4A, 4B and 4C respectively correspond to FIGS. 3A, 3B and 3D but showing the position of the components when the pressure of the inflation fluid is reduced after completion of the filling and expanding of the inflatable packer unit.

At the conclusion of the cementing operation, however, the pressure of the cementing fluid is reduced by the operator, and the upper sleeve valve 40 will move downwardly until enlarged portion 42 abuts shoulder 15*f* of upper outer wall portion 15, so that the radial ports 14*d* are straddled by the internal seal 40*a* and an internal seal 40*c* provided in the enlarged upper portion 42 of upper sleeve 40 (FIG. 4A).

There are ports 12*e* provided in the outer wall 12 to communicate with the well bore and prevent the buildup of fluid pressure within the valving assemblage 10.

Figure 2A:
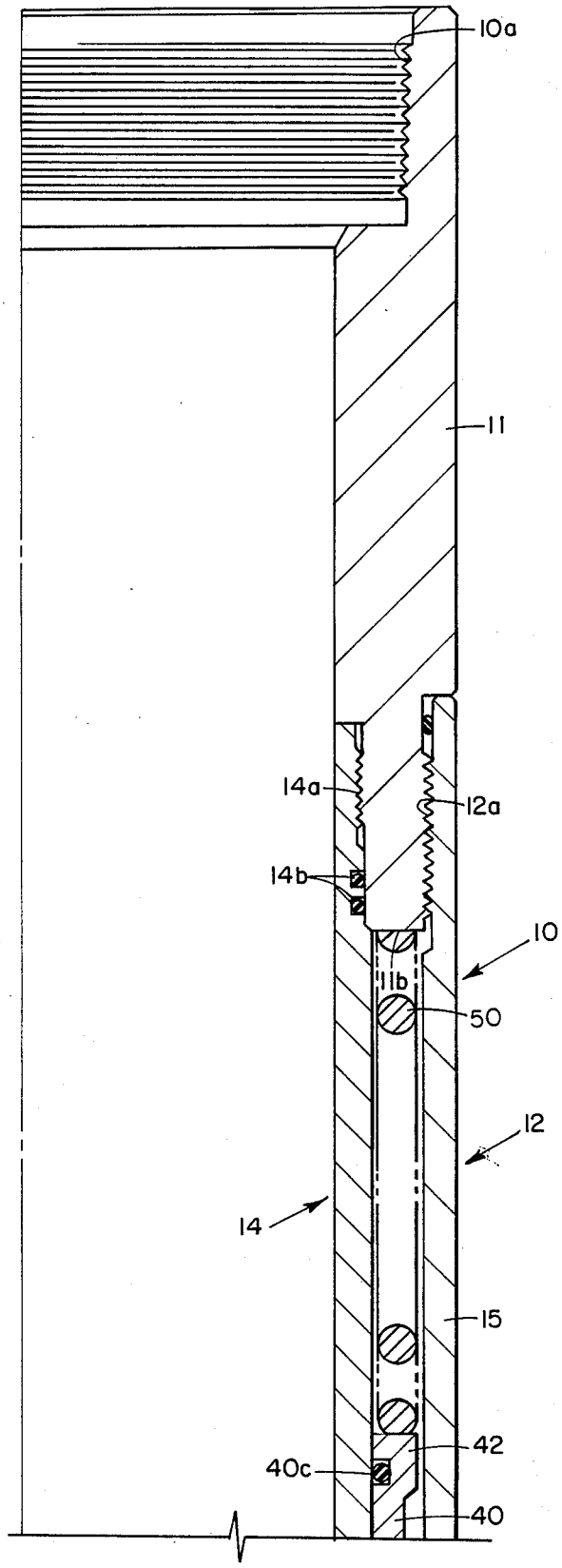
FIGS. 2A, 2B and 2C respectively correspond to FIGS. 1A, 1B and 1C but showing the position of the components upon the application of pressured inflation fluid to the inflatable packer.
Figure 2B:
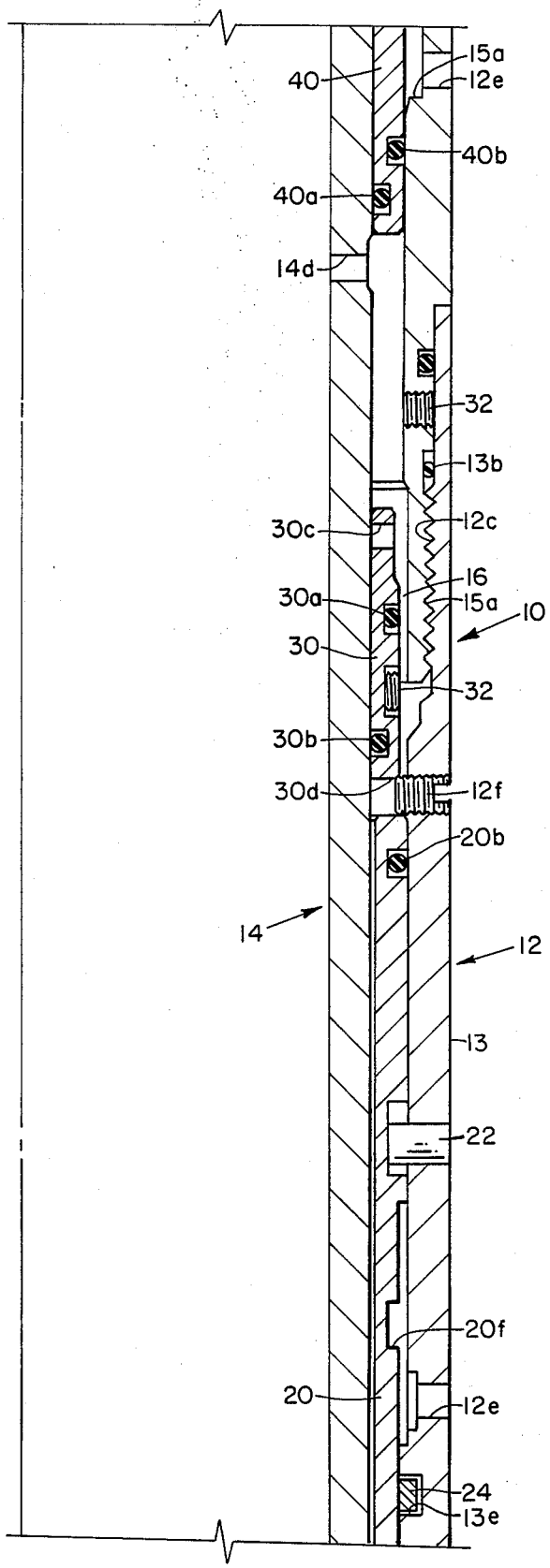
Figure 1C:
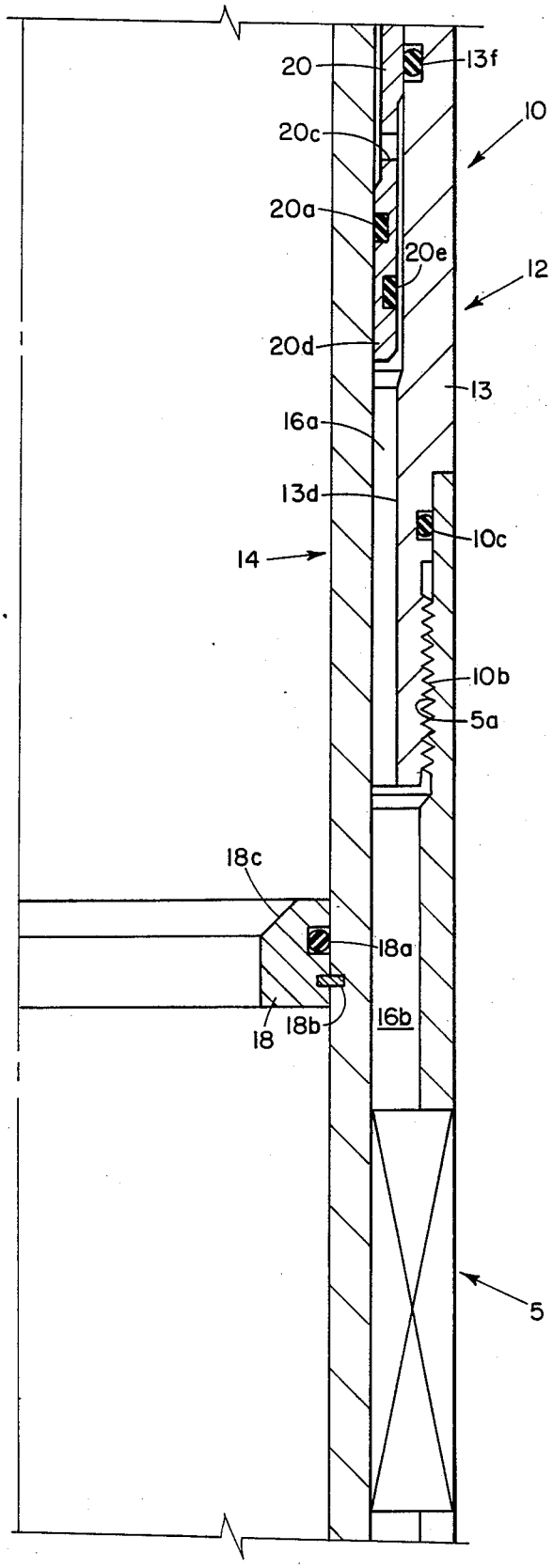
Figure 2C:
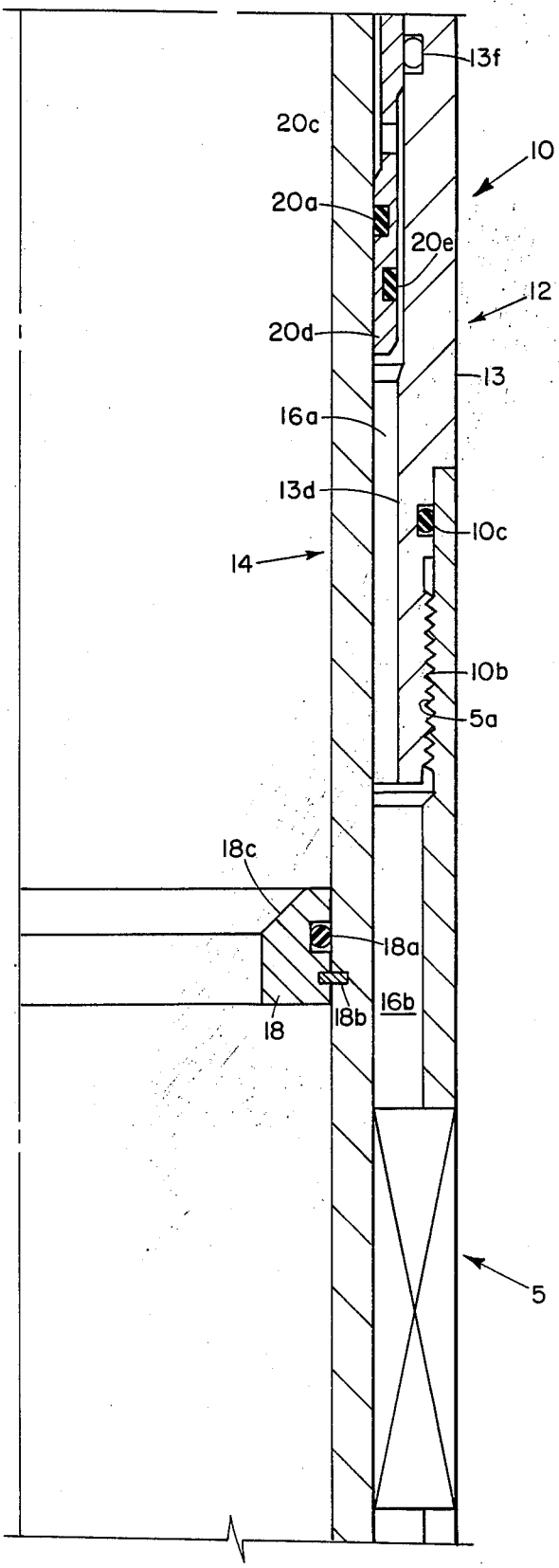
Figure 3A:
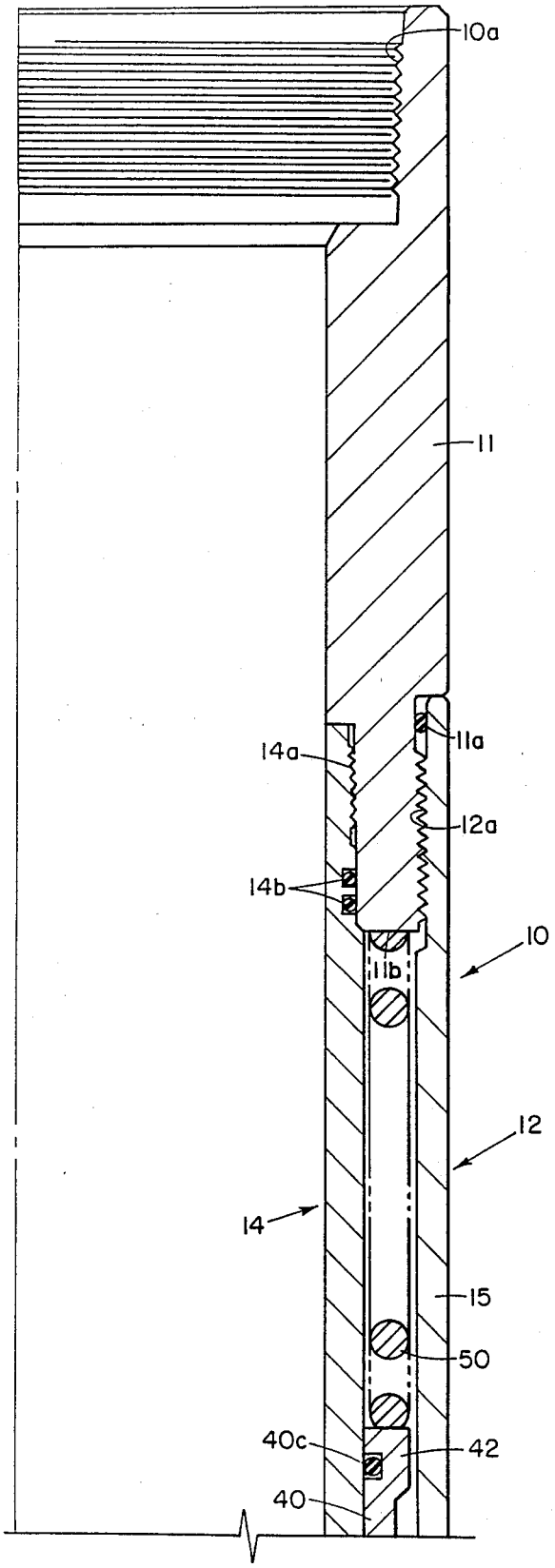
FIGS. 3A, 3B and 3C respectively correspond to FIGS. 2A, 2B and 2C but showing the position of the components when the inflatable packer has been expanded and filled with inflation fluid.
Figure 3C:
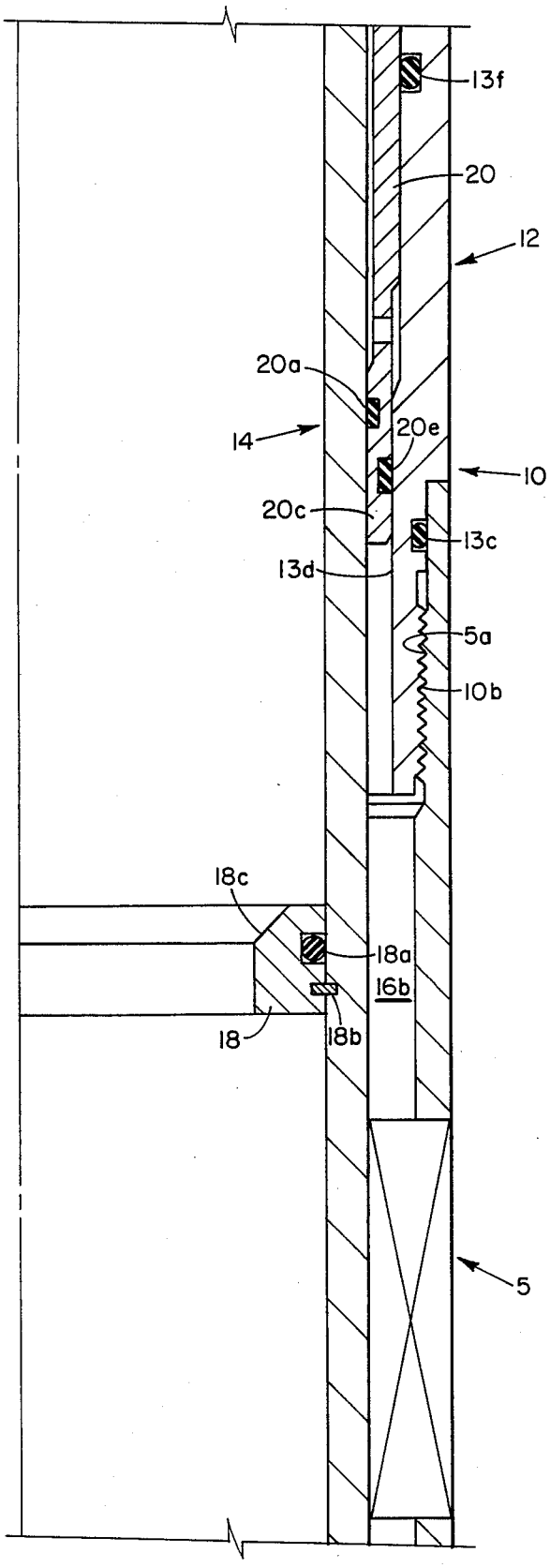

The operation of the aforedescribed apparatus will be readily apparent to those skilled in the art. After the run-in of the inflatable packer to the desired position in the well, the bottom end of the inner wall 14, which constitutes an extension of the casing bore, may extend a considerable distance below the tool and is sealed in any conventional fashion as by having an annular valve seat 18 sealably mounted within the bore of inner wall 14 by O-ring 18*a* and shearably secured in position below the radial ports 14*d* by a shearable snap ring 18*c*. However, for illustrative purposes, only, the ring 18 is shown within the bore of the tool although those skilled in the art will appreciate that the seal in the casing bore will, in commercial embodiments, be positionable anywhere below the tool. A plug or ball (not shown) is then dropped or pumped down the bore of the casing string to seat on the upwardly inclined surface 18*c* of the valve seat ring 18. Thus, cementing fluid can be supplied through the bore of the casing string and the pressure of such cementing fluid increased to a level sufficient to effect the shearing of shear pin 32, causing intermediate valve 30 to move downwardly and permit the pressured cementing fluid to flow around the lower sleeve valve 20 and into the inlet passage 16*b* of the inflatable packer 5, as shown in FIG. 2B. The packer 5 is thus expanded and filled with cementing fluid. As it nears the fill point, the pressure of the cementing fluid flowing thereinto is sharply increased. This increased pressure acts upon a differential area defined between a seal 13*f* provided in the lower part 13 of the outer wall 12 and the O-ring 20*b*, resulting in a downward force sufficient to effect the shearing of shear pin 22 and permit the lower sleeve valve element 20 to move to its closing position as shown in FIGS. 3B and 3C. The closing of sleeve valve 20 thus insures that any subsequent leakage through the inflated packer will not enter the interior of the valving structure, and hence destroy the integrity of the seal provided by the inflated packer.

Figure 4B:
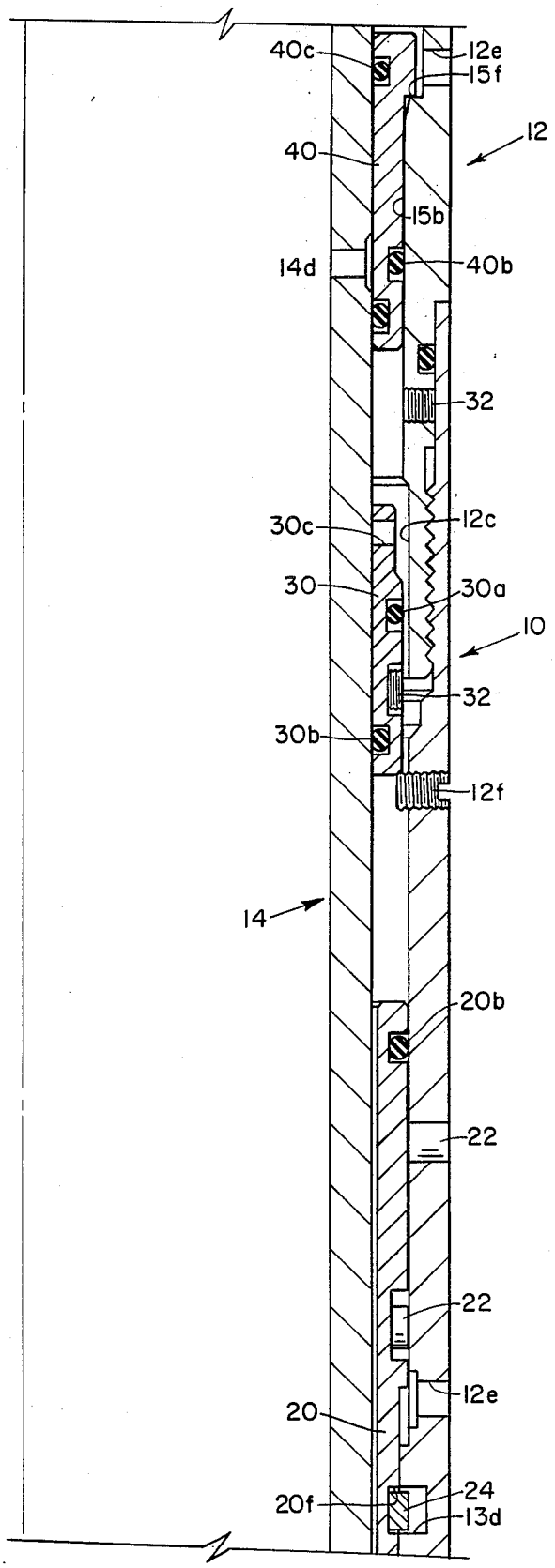

After such downward movement, the operator reduces the pressure of the cementing fluid and this results in the automatic downward movement of the upper sleeve valve 40 to its lower position (FIG. 4B) wherein the ports 14*d* are sealed off by O-rings 40*a* and 40*c* carried by the upper sleeve valve element 40. It should be noted that the upper sleeve valve 40 is permanently shifted to this position in that no changes in fluid pressure within or without the bore of the casing will cause the valve to move upwardly and reopen the ports 14*d*.

Figure 4C:
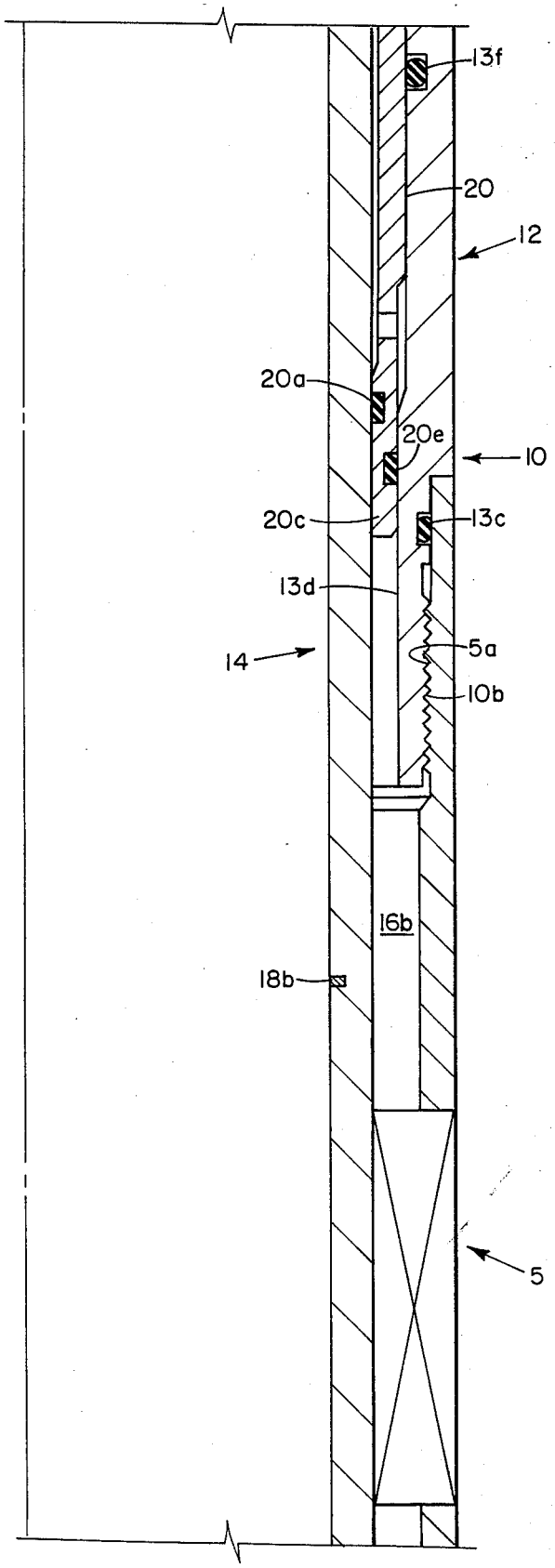

A subsequent large increase in fluid pressure supplied to the casing bore will shear the shear ring 18*b*and force the ball and ball seat to the bottom of the well, as indicated in FIG. 4C.

It is therefore apparent that the aforedescribed construction provides a unique method and apparatus for effecting the supply of cementing fluid through large flow area passages to an inflatable packer mounted on the bottom end of a casing string, followed by the sealing off of any passages leading to the inflatable packer, as well as the sealing off of ports communicating with the internal bore of the casing string. The advantages of this construction will be readily apparent to those skilled in the art. The inflation fluid may be cemented used to secure casing to the bore hole wall, or may be any other fluid conventionally known to those skilled in the art for inflation of packer-like seal mechanisms in subterranean wells.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for sealing a casing in a subterranean well bore, comprising, in combination:

a tubular valving assemblage attachable to the the casing;

said tubular valving assemblage comprising concentric inner and outer tubular bodies defining an elongated annular chamber therebetween;

port means in said inner tubular body communicating with the bore of said casing, whereby an inflation fluid supplied through said casing can enter said annular chamber through said port means;

an inflatable packer secured to the tubular valving assemblage and having a fluid inlet passage communicating with said annular chamber;

first sleeve valve means disposed in said annular chamber above said fluid inlet passage;

said first sleeve valve means having an upper position permitting pressured inflation fluid to flow into said fluid passage means to inflate said inflatable packer and a lower position preventing fluid flow into said fluid passage means;

first shearable means securing said first valve means in said upper position; and seal means on said first sleeve valve means cooperating with one at least wall of said annular chamber to produce an upwardly facing piston area, whereby an increase in the inflation fluid pressure resulting from filling the inflatable packer will produce a downward force on said first sleeve valve to move same to said lower position.

2. The apparatus of claim 1 further comprising:

a second sleeve valve disposed in said annular chamber above said port means and shiftable between a first position allowing communication between said port means and said annular chamber and a second position preventing communication between said port means and said annular chamber;

said second sleeve valve being biased to said first position by the pressured inflation fluid in said annular chamber; and resilient means biasing said second sleeve valve means to said second position, whereby reduction in pressure of said inflation fluid closes said port means.

3. The apparatus of claim 2 further comprising a third sleeve valve means shearably positioned in said annular chamber to prevent flow of well fluids through said port means to said first sleeve valve means during run-in of the casing and inflatable packer.

4. The apparatus of claim 3 wherein said second sleeve valve means is held by said resilient means in abutting relation to said third sleeve valve means during run-in of the casing and inflatable packer.

5. The apparatus of claim 1 further comprising means for locking said first sleeve valve means in said lower position.

6. The method of sealing a casing string in a well bore comprising the steps of:

securing a valve housing and an inflatable packer to the casing string, said housing defining a vertically extending annular chamber defined by inner and outer walls communicating with the inflatable packer, the inner wall having a port connecting said annular chamber to the casing bore;

running the casing string in the well to a desired depth;

maintaining said port closed during run-in;

supplying pressured inflation fluid through the casing bore;

opening said port in response to the pressured inflation fluid to permit inflation fluid to flow into the inflatable packer;

closing communication between said annular chamber and the inflatable packer in response to the filling of the inflatable packer with inflation fluid;

reducing the pressure of the inflation cementing fluid; and permanently closing said port in response to said decrease in fluid pressure of said inflation fluid.

7. The method of sealing a casing in a well bore comprising the steps of:

securing a valve housing and an inflatable packer to the bottom of the casing string, said housing defining a vertically extending annular chamber defined by inner and outer walls communicating with the inflatable packer, the inner wall having a port connecting said annular chamber to the casing bore;

providing a first sleeve valve in said chamber shearably positioned to prevent fluid flow from the casing bore through said port into said annular chamber during run-in;

providing a second sleeve valve in said annular chamber shearably positioned to permit fluid flow from the annular chamber into the inflatable packer;

providing a third sleeve valve in said annular chamber spring biased to a position to prevent fluid flow through said port when said first sleeve valve is shifted from its run-in position and fluid pressure is not present in said annular chamber;

running the casing string in the well to a desired depth;

supplying pressured inflatoin fluid through the casing to shift the first sleeve valve to permit the inflation fluid to fill the inflatable packer;

shifting said second sleeve valve by fluid pressure to a position interrupting fluid flow into said inflatable packer when said inflatable packer is filled with inflation fluid; and decreasing fluid pressure in said annular chamber to permit said third sleeve valve to shift to close said port.

* * * * *